US009351558B2

(12) United States Patent
Burke

(10) Patent No.: US 9,351,558 B2
(45) Date of Patent: May 31, 2016

(54) TOOL ATTACHMENT SYSTEM

(75) Inventor: Craig Andrew Burke, Neutral Bay (AU)

(73) Assignee: ROCKA DEVICES PTY. LTD. (AU)

( * ) Notice: Subject to any disclaimer, the term of this patent is extended or adjusted under 35 U.S.C. 154(b) by 0 days.

(21) Appl. No.: 13/880,757

(22) PCT Filed: Oct. 27, 2011

(86) PCT No.: PCT/AU2011/001377

§ 371 (c)(1),
(2), (4) Date: Apr. 22, 2013

(87) PCT Pub. No.: WO2012/054979

PCT Pub. Date: May 3, 2012

(65) Prior Publication Data

US 2013/0212837 A1 Aug. 22, 2013

(30) Foreign Application Priority Data

Oct. 27, 2010 (AU) ..... 2010904784

(51) Int. Cl.
*A45F 5/00* (2006.01)
*B25H 3/00* (2006.01)

(52) U.S. Cl.
CPC .. *A45F 5/00* (2013.01); *B25H 3/00* (2013.01); *Y10T 24/1394* (2015.01)

(58) Field of Classification Search
CPC ..... A45F 5/00; B25H 3/00; Y10T 24/1394
USPC ..... 24/3.12
See application file for complete search history.

(56) References Cited

U.S. PATENT DOCUMENTS

| | | | | | |
|---|---|---|---|---|---|
| 1,650,802 | A | * | 11/1927 | McLoughlin | 24/577.1 |
| 2,832,120 | A | * | 4/1958 | Jayet | 24/632 |
| 3,621,651 | A | * | 11/1971 | Gillespie | 59/85 |
| 3,789,467 | A | * | 2/1974 | Aratani et al. | 24/648 |
| 4,681,039 | A | * | 7/1987 | Perrin | 104/193 |
| 5,267,377 | A | * | 12/1993 | Gillis et al. | 24/641 |
| 6,308,385 | B1 | * | 10/2001 | Ball | 24/574.1 |
| 2009/0241305 | A1 | * | 10/2009 | Buckingham | 24/599.1 |
| 2010/0147912 | A1 | * | 6/2010 | Salentine | 224/254 |

FOREIGN PATENT DOCUMENTS

| | | |
|---|---|---|
| JP | 54149232 | 6/1981 |
| JP | H0673895 | 3/1994 |

* cited by examiner

*Primary Examiner* — Robert J Sandy
*Assistant Examiner* — David Upchurch
(74) *Attorney, Agent, or Firm* — Galbreath Law Offices, P.C.; John A. Galbreath

(57) ABSTRACT

An attachment device (10) adapted for use with at least two retainers (14), the device (10) including at least two mountings (44), each for engagement with a retainer (14), wherein when a first one (14*a*) of the retainers is engaged with the device (10) it cannot be detached from the device until another retainer (14*b*) has been engaged with the device (10).

29 Claims, 14 Drawing Sheets

410
414
425
424
414
424
412
425

414
444
444a
412
436

410
422
412
422
444a 412
424
414
422
444b
425
436
444a
422

TOOL ATTACHMENT SYSTEM

FIELD OF INVENTION

This invention relates to tool holders and more particularly to securely retaining tools and other implements when working above ground or water so as to prevent accidental dropping of such items. However, the invention is not limited to such uses.

BACKGROUND

When working with tools and other objects above ground there is always a risk that an item will be accidentally dropped. A relatively small object can cause serious injury or even death if it falls on a person below or significant damage to property.

The present invention aims to provide a system that reduces and preferably prevents accidental dropping of objects.

SUMMARY OF THE INVENTION

In one broad form the invention provides an attachment device adapted for use with at least two retainers, the device including at least two mountings, each for engagement with retainer, wherein when a first one of the retainers is engaged with the device it cannot be detached from the device until another retainer has been engaged with the device.

In a preferred form the device is provided with two mountings.

In a preferred form the device includes a latch mechanism that, for each mounting, includes a portion movable between first and second positions. In a preferred form a portion of the latch mechanism is in the first position for a first mounting when another portion of the latch mechanism in a second position for a second mounting.

The latch mechanism is preferably a structure that moves as one (whether formed as one part or of multiple components) but may be formed of two or more components that move relative to each other.

In a preferred form in the first position a retainer in a first mounting to the device is secured whilst a retainer in at least one other mounting is free to be attached or detached from the device.

In a preferred form in a position intermediate the first and second positions retainers engaged with at least two mountings are preferably secured to the device and none cannot be removed until a portion of latch mechanism has moved to the first position of at least one mounting.

In a preferred form the latch mechanism includes a member that rotates about an axis of rotation between the first and second positions. The member may move between the first and second positions by non rotary motion, such as by linear sliding motion.

Preferably the device includes a bias member to bias the latch mechanism or portions of the latch mechanism to the first or second positions. Preferably the bias member is more biased at an intermediate position than the first and second positions, i.e. there is an over centre action.

Preferably the latch mechanism is configured such that movement of a retained retainer draws the respective portion of the latch mechanism further away from the intermediate position.

In a preferred form the device includes two slot like mountings into each of which a retainer may be received. When a slot is open at a first end to receive a retainer preferably a first portion of the latch mechanism extends into the slot remote from the first end against which the retainer bears as it is passed into the slot. Continued motion of the retainer into the slot causes the latch mechanism to move to pass a second portion of the latch mechanism across the slot between the retainer and the first end, thereby closing the slot.

Preferably first portion of the latch mechanism presents a face angled to the slot.

Preferably the second portion of the latch mechanism presents a face angled to the slot against which the retainer may bear.

Preferably each slot is closed at a second end such that entry and exit of a retainer from the slot is via the first end. However, one or more slots open at both ends may be provided with a latching mechanism configured to allow entry and exit from either end.

In a preferred form the device has a latch with a head and a tail and is mounted for rotation about an axis intermediate the head and tail. Two blind slots extend either side of the axis and the latch rotates between first position and second positions. In either first or second position the head extends across a first one of the slots remote from the end, so as to close the first slot and retain any retainer in that first slot and the tail extends across the other slot remote from the open end. When a retainer is passed into the open slot it engages the tail and causes the latch to rotate to the other of the first and second positions, with the head extending across the second slot and not the first slot. Preferably at an intermediate position the head extends across both slots and prevents removal of a retainer located in either slot between the blind end and the head for being removed.

In another broad form the invention provides an attachment device adapted for use with at least two retainers, the device including:

- at least two mountings, each for engagement with a retainer, each mounting, including at least one latch portion movable between a retaining position in which the at least one latch portion prevents removal from the mounting of a retainer engaged with, retained by or otherwise restrained by the mounting and an open position in which a retainer may be disengaged from the mounting;
- each mounting also including at least one release portion for causing at least one latch portion of at least one other mounting to move from a retaining position to an open position.

The or each mounting may include a volume into which a retainer is received. The or each volume may include an opening through which a retainer passes during engagement and disengagement with the mounting.

The at least one latch portion may extend into the volume when in the retaining position. The at least one latch portion may extend into the volume intermediate the retainer and the opening when in the retaining position.

The at least one release portion may extend into the volume when in the first position. The at least one release portion may extend into the volume and the retainer is intermediate the opening and the release portion.

The at least one release portion for at least one latch portion of a first mounting may extend into the volume of another mounting when the at least one latch portion is in the retaining position. A latch portion of a first mounting may be in the retaining position when a latch portion of a second mounting is in an open position.

Movement of a latch portion of a first mounting between the retaining position to an open position may occur with movement of a latch portion of a second mounting between the retaining position to an open position.

Latch portions of at least two mountings may be constrained to move as one.

The attachment device may include at least one latch member. The at least one latch member may have at least one latch portion. The at least one latch member may have at least one release portion. Latch portions of at least two mountings may be located on a single latch member. Release portions of at least two mountings may be located on a single latch member. Latch portions of at least two mountings may be located on different latch members. Release portions of at least two mountings may be located on different latch members.

The or each at least one latch member may be mounted for rotation about a respective axis of rotation. There may be at least two latch members, each latch member having at least one latch portion and at least one release portion.

There may be at least two latch members mounted for rotation about a common axis.

In the first position a retainer in a first mounting to the device may be secured whilst a retainer in at least one other mounting is free to be engaged or disengaged from the device.

When corresponding latch portions are in a position intermediate the retaining and open positions, retainers engaged with at least two mountings may be secured to the device and none cannot be removed until one of the latch portions has moved to the first position of at least one mounting.

The device may include at least one bias member to bias at least one latch portion to a retaining position. The at least one bias member may be less biased when a latch portion is in at least one of the retaining or open positions than when the latch portion is intermediate the retaining or open positions.

Movement of a retainer engaged with a mounting may draw a latch portion further toward the retaining position. The latch portion drawn further toward the retaining position may be associated with the mounting in which the retainer is retained. The latch portion drawn further toward the retaining position may be associated with a mounting different to that in which the retainer is retained.

The at least one mounting may constrain the retainer to move along a path. The at least one latch portion may presents a corresponding face angled to the path, against which the retainer may bear. The at least one release portion may presents a corresponding face angled to the path, against which the retainer may bear.

The device may include at least one slot like mounting into each of which a retainer may be received. At least one slot may be closed or substantially closed at a second end such that entry and exit of a retainer from the slot is via the first end. At least one slot may be open at both ends and at least one of the at least one latch portion and the at least one release portion configured to allow entry and exit from either end.

The device may have:

at least one latch with at least one head and at least one tail and mounted for rotation about a respective axis intermediate the head and tail;

the at least one head comprising at least one latch portion; the at least one tail comprising at least one release portion;

at least two blind slots extending either side of the axis;

the at least one latch rotatable between first and second positions;

wherein in either first or second position a head extends across a first one of the slots remote from the end, so as to close the first slot and retain any retainer in that first slot and the tail extends across a second slot remote from the open end, and when a retainer is passed into the second of said slots it engages the tail and causes the latch to rotate to the other of the first and second positions, with the head extending across the second slot and not the first slot.

In another broad form the invention provides an attachment system that includes an attachment device in all forms of the invention together with one or more retainers.

Unless the context clearly requires otherwise, throughout the description and the claims the words 'comprise', 'comprising', and the like are to be construed in an inclusive sense as opposed to an exclusive or exhaustive sense; that is to say, in the sense of "including, but not limited to".

DETAILED DESCRIPTION OF PREFERRED AND OTHER EMBODIMENTS

Referring to FIGS. 1 to 7 there is shown a safety tool attachment system 10 according to one implementation of the invention. The system includes a tool mounting 12 and two retainers 14*a*, 14*b*.

The tool mounting 12 may be attached directly to a tool 15 or may be attached via tether 16.

Figure 1:
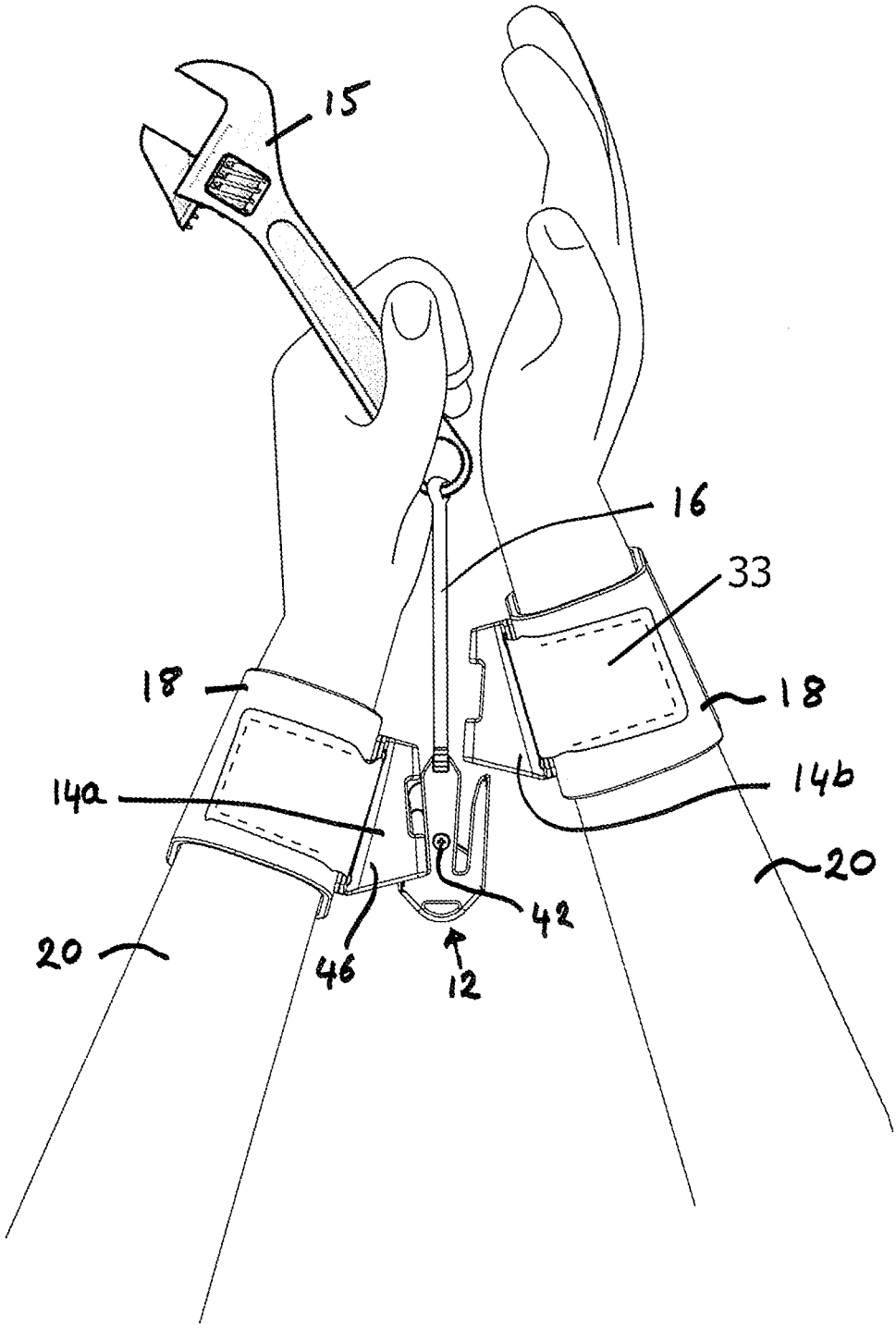
FIG. 1 is a schematic perspective view of an attachment system according to an embodiment of the invention.
Figure 2:
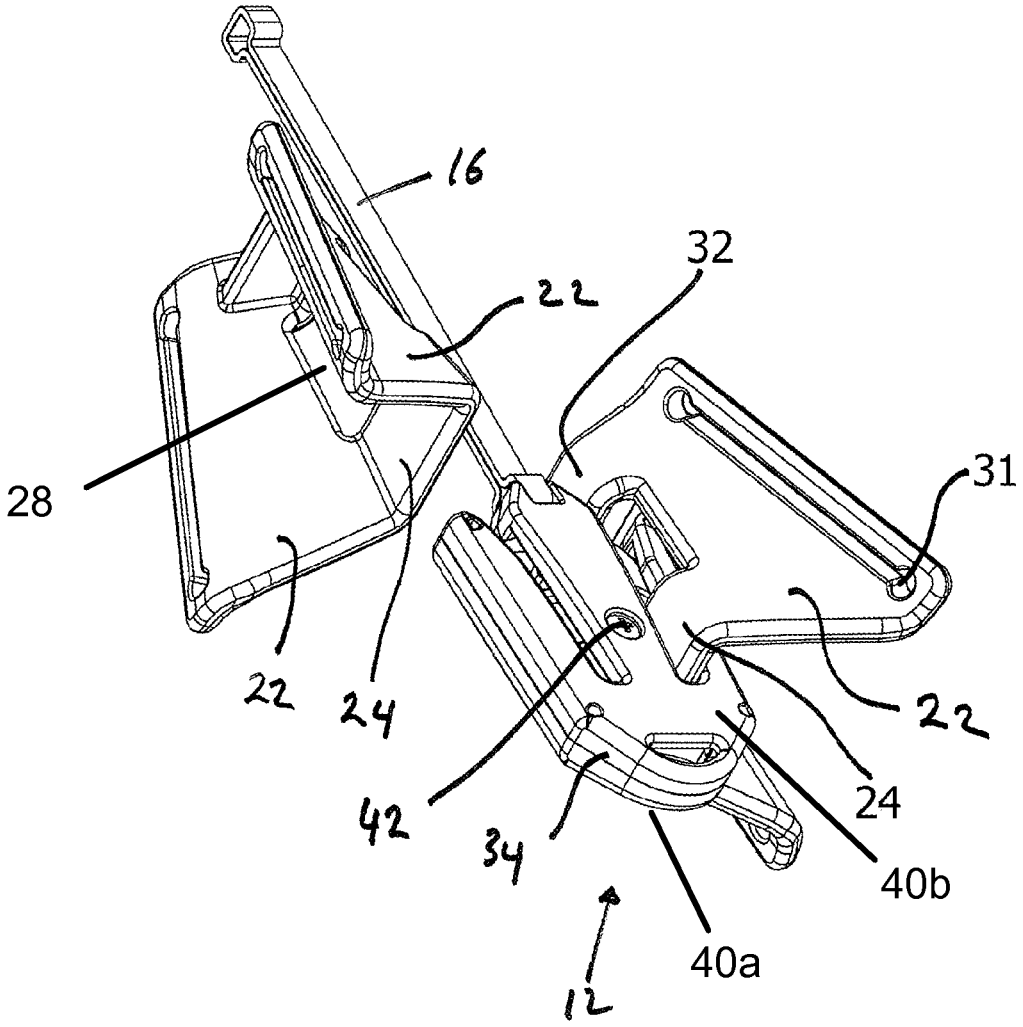
FIG. 2 is a perspective view of the components of FIG. 1 with a mounting engaged with a first retainer.

The retainers 14 are mounted to a suitable object. In FIG. 1 the retainers 14 are mounted on wrist straps 18 which in turn are mounted on the arms 20 of a user. The retainers 14 have slots 31 through which a strap may pass, such as strap 33 of wrist straps. The slots 31 are also shaped so that a screw, bolt, rivet or similar fastener may pass through at either end into a solid object, such as a post or other suitable structure.

The retainers 14*a*, 14*b* are identical to each other each and have two spaced apart side plates 22 joined by rib 24. Openings 26 and 28 are thus located either side of rib 24. Additional rib 32 serves to space and join two side plates 22 together and delineate the opening 28. The rib 24 is generally elongate and linear. The rib 24 may also be circular in cross-section.

The tool mounting 12 includes a housing 34 with a latch 36 pivotably mounted on axle 38. The housing 12 may be formed of two side plates 40*a* and 40*b* joined together. A screw 42 may serve to hold the two plates 40*a* and 40*b* together and function as the axle 38. The housing 12 defines two elongate slots 44 extending either side of axle 38.

The latch 36 is elongate and symmetrical about its longitudinal axis and includes an arrow shaped head 46 at one end and a tail 48 at the other end, with axle 38 located in between. Tail 42 has two faces 50 and 54 angled to each other and the longitudinal axis. The housing 12 includes leaf spring 52 that engages one or other of the faces 50 and 54 and serves to bias the latch 36 to be pivoted to one or the other sides of the axis of the housing. The angled nature of the faces 50 and 52 provides an over centre action that causes the latch 36 to "flip" from one side to the other when rotated and serves to bias the latch 36 to whichever current position it holds. Other over centre action mechanisms may be used.

The slots 44 are sized to receive rib 24 of a retainer 14.

Figure 3:
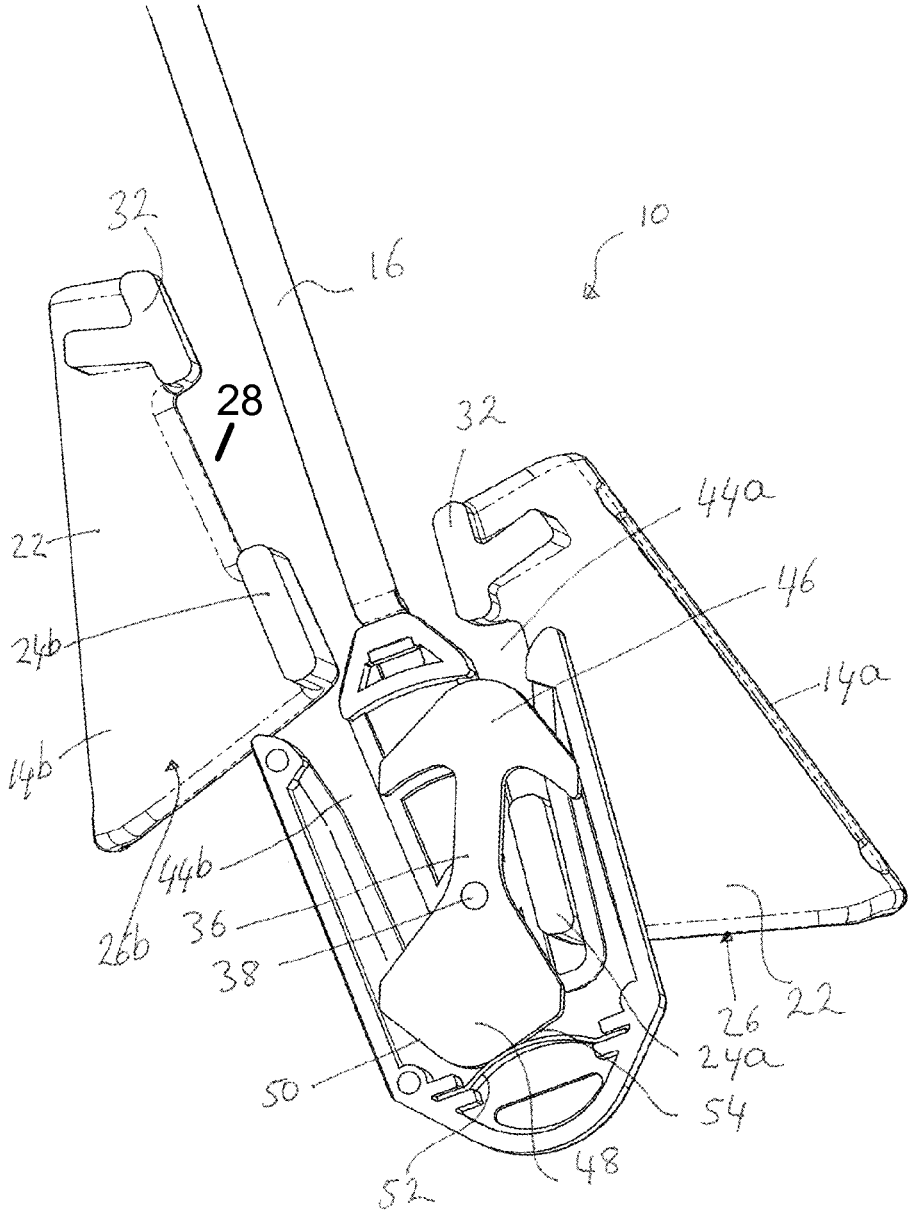
FIG. 3 is a sectioned view of the components of FIG. 1 with a mounting engaged with a first retainer.
Figure 4:
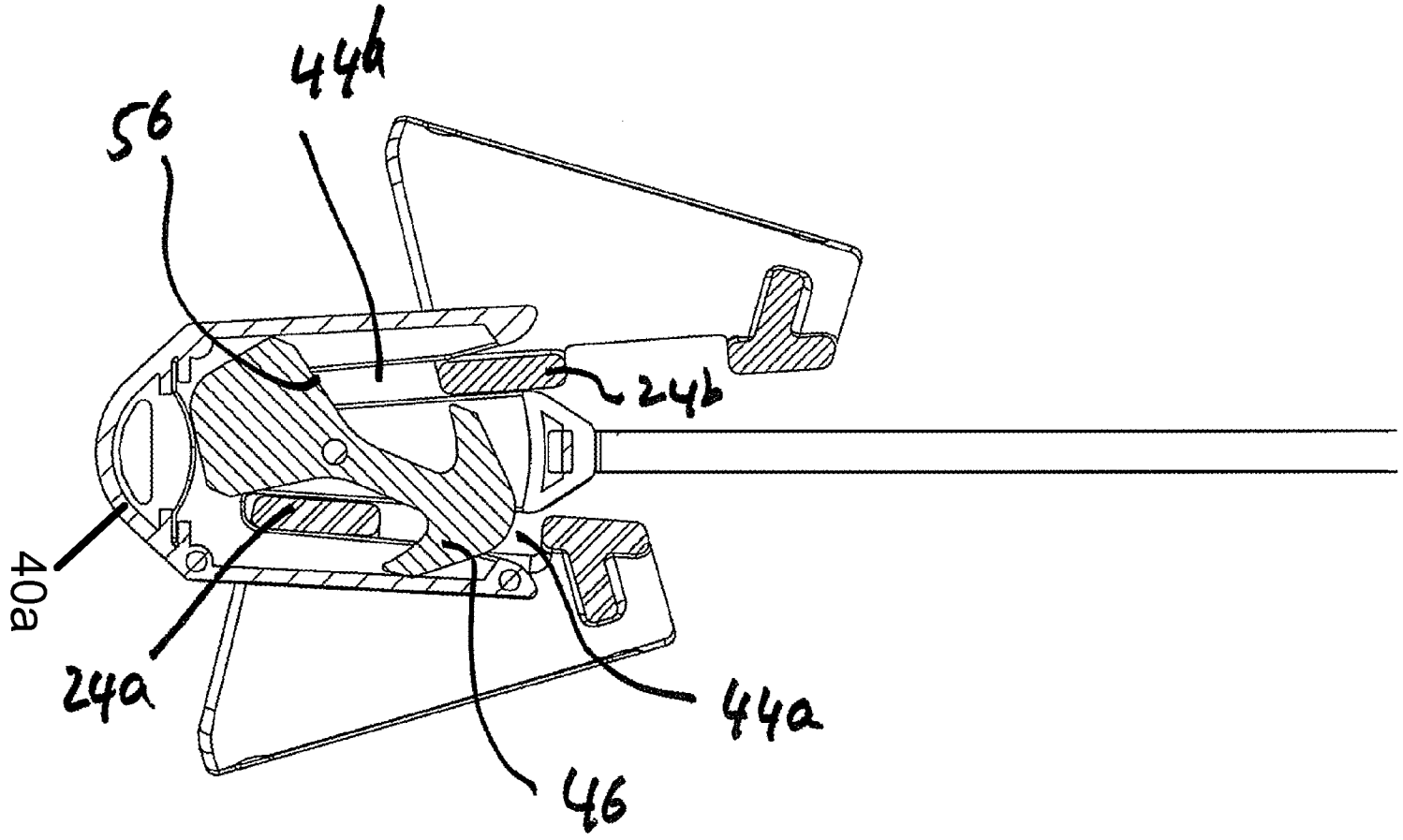
FIG. 4 is a sectioned view of the components of FIG. 1 with a mounting engaged with a first retainer and with a second retainer entering the mounting.

As seen in FIGS. 3 and 4 the latch 36 is oriented with head 46 extending over slot 44*a* and traps rib 24*a* between the head and the blind end of the slot 44*a*. Because rib 24*a* is connected to side plates it cannot be removed sideways from the slot. The rib is trapped in the slot 44*a* and so the tool mounting 12 is secured to the retainer 14*a* whilst the head overlays the slot 44*a*. The latch 36 is maintained in this position by the spring 52.

The tail 48 has an angled face 56*a* that extends into the slot 44*a*. Relative movement of the rib 24*a* along the slot 44*a* toward the tail will cause the latch 36 to rotate so as to cause more of head 46 to extend over the open end of slot 44*a*. Movement of rib 24*a* toward the open end of slot will cause the rib 24*a* to engage angled face 58 and also cause more of head 46 to extend over the open end of slot 44*a*. Thus movement in either direction along slot 44 increases retention of the rib in the slot.

Slot 44*b* is open and the mounting 12 may be moved relative to retainer 14*b* so that rib 24*b* enters slot 44*b*. The head 46 does not impede the rib 24*b*. However, preferably the front faces 60 of the head are angled so that if they did extend into the slot entry of a rib will push them sideways and allow entry of the rib. The rib 24*b* moves into the slot and engages face 56*b* of tail. The face 56*b* is angled such that continued movement of the rib 24*b* toward the base of the slot 44*b* causes the latch 36 to rotate against the biasing force of the spring. Rotation continues until the tail 48 passes over the centre point and "flips" to the other orientation, with the head extending over slot 44*b*. The length of the rib relative to the spacing of the head and tail is such that the rib 24*b* is located past the head and does not impede the rotation of the latch.

Figure 5:
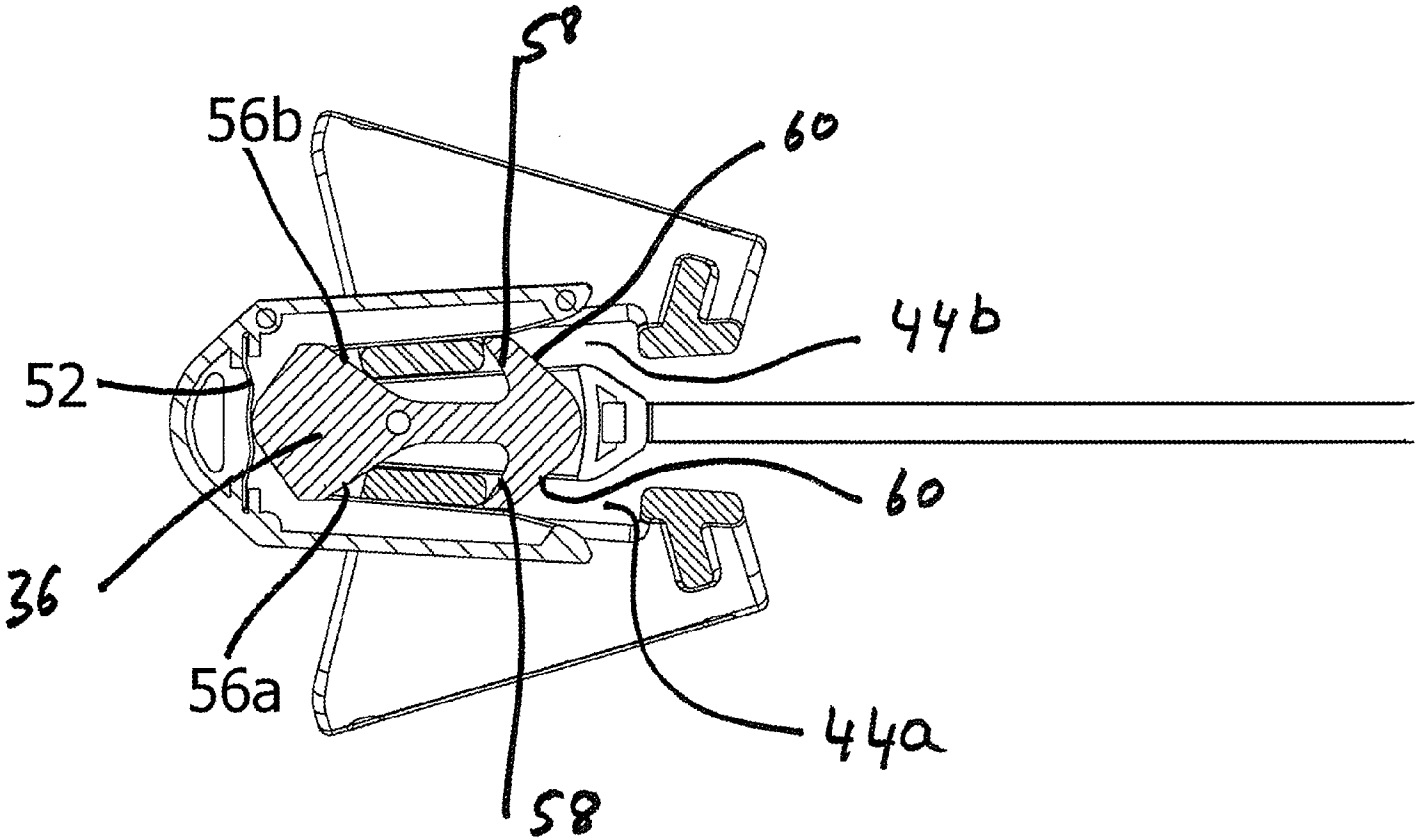
FIG. 5 is a sectioned view of the components of FIG. 1 at an intermediate state with the mounting engaged the first and second retainers.
Figure 6:
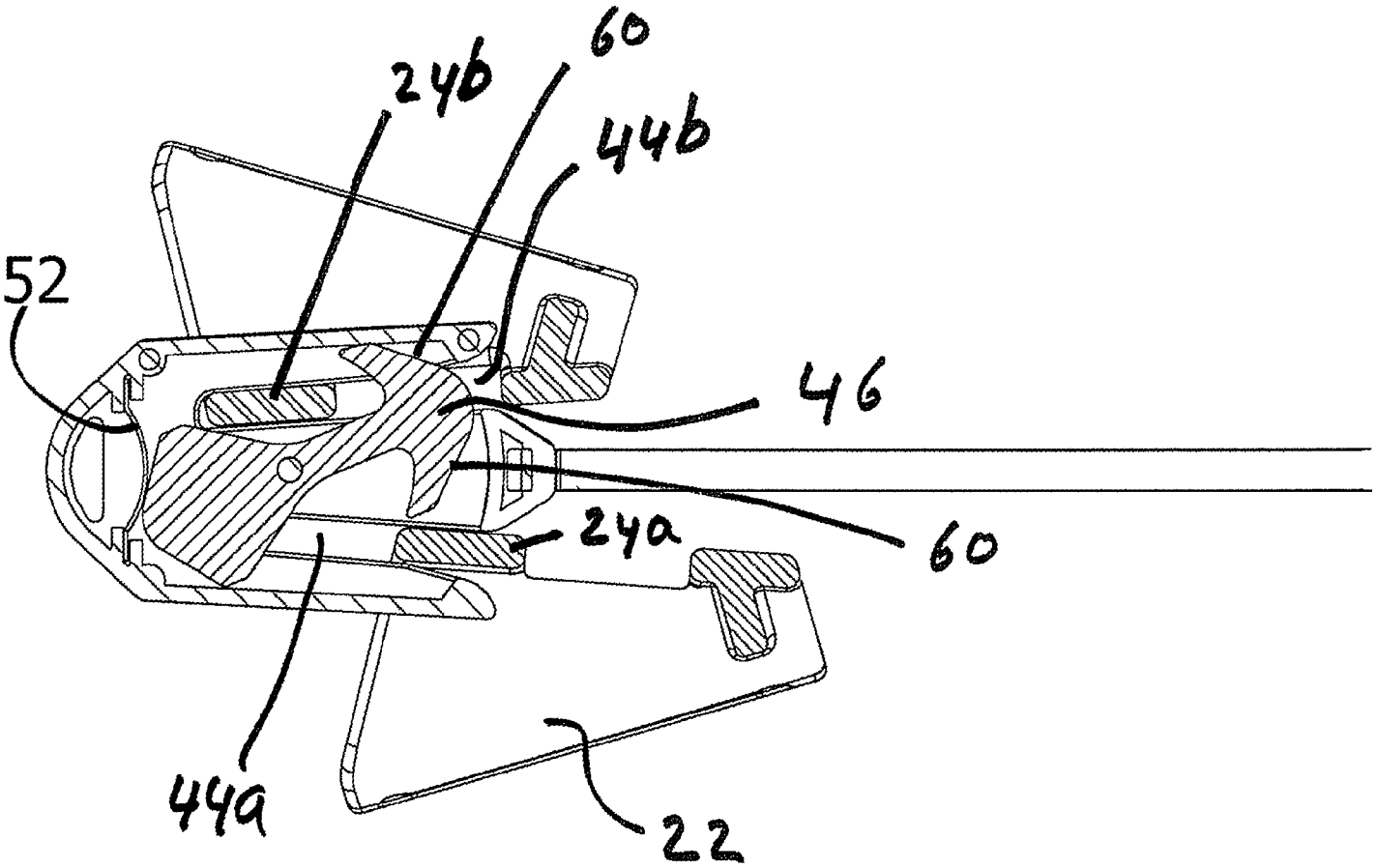
FIG. 6 is a sectioned view of the components of FIG. 1 with the mounting fully engaged the second retainer and the first retainer being removed from the mounting.

Referring to FIG. 5, at the centre position, the head 46 extends over both slots 44*a* and 44*b* and the tool mounting 12 is secured to both tool retainers 14*a* and 14*b*.

When the latch flips so that head covers slot 44*b* and traps rib 18*b*, it uncovers slot 44*a* and so rib 24*a* may be moved out of the slot 44*a* and engagement with the housing, as seen in FIG. 5. The tool holder 12 is now secured to retainer 14*b* and not to retainer 14*a*.

Thus the tool holder 12 remains attached to at least one retainer at all times. As such, so long as the retainers are suitably retained a tool attached to the tool holder cannot be dropped.

Figure 7:
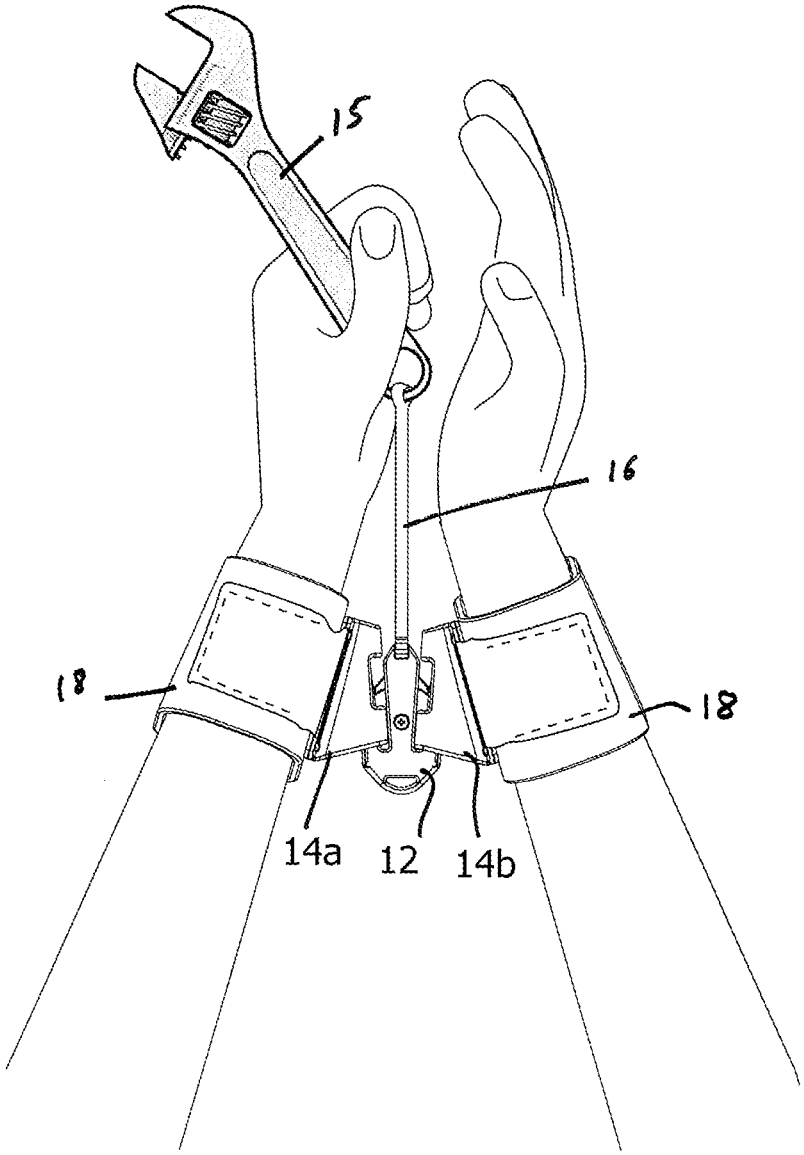
FIG. 7 is a perspective view of the system with retainers mounted on arms of a user and in the state of FIG. 5.

FIG. 7 schematically shows an arrangement corresponding to FIG. 5 in which both retainers 14*a*, 14*b* are secured to the tool holder.

Figure 8:
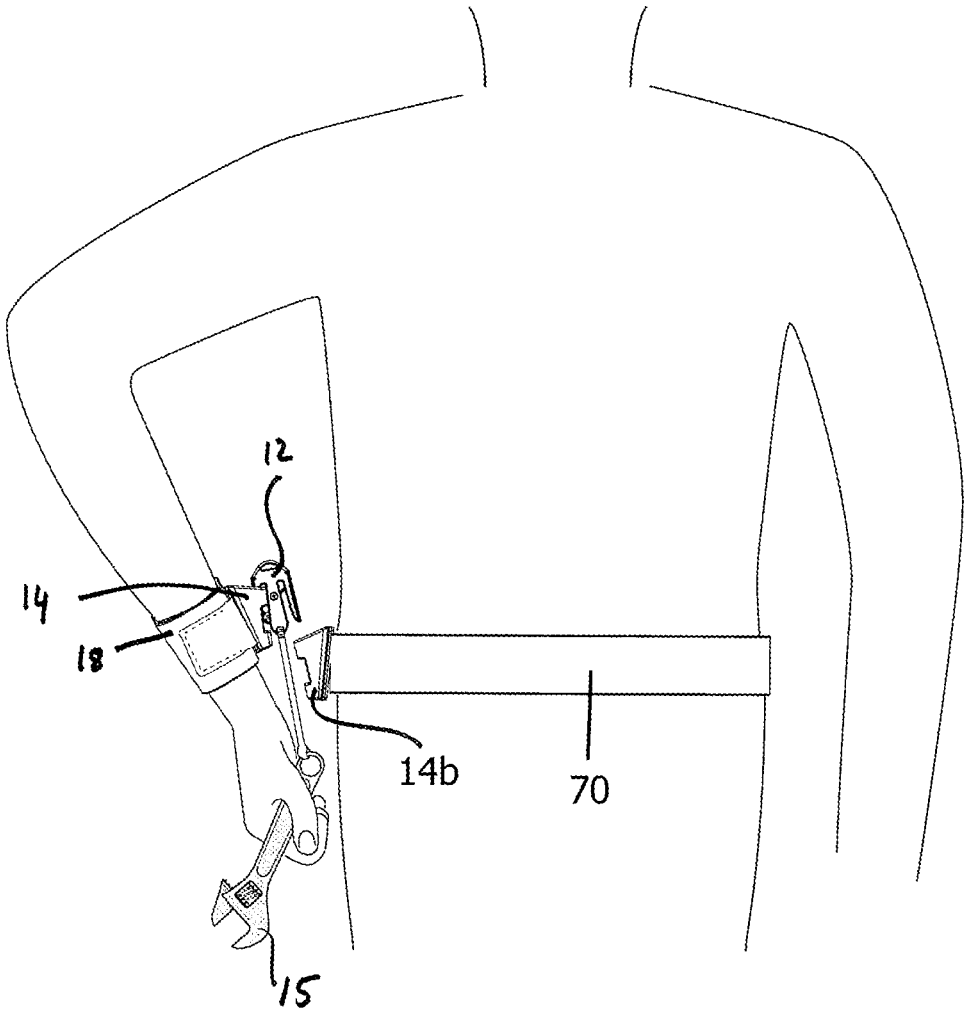
FIG. 8 is a perspective view of the system with a retainer mounted on a waist belt of a user.

FIG. 8 schematically shows an arrangement in which a retainer 14*a* is mounted on a wrist strap 18 and another retainer 14*b* is secured to a belt 70 on a user's torso. A tool holder 12 may be transferred from the user's arm 20 to the belt 70 as described above. The belt 70 may be provided with multiple retainers 14 with a tool secured to each retainer. Since each tool holder 12 must be engaged with another retainer before it can be disengaged from the waist belt 70, it is not possible to have one or more loose unsecured tools. The user may have more than one retainer on each arm and may have retainers on both arms. Thus if a user needs to work with a tool held in their left hand, the tool holder 12 may be secured to a retainer on the left arm. If use with the right arm is desired the tool holder 12 can be transferred from the left arm retainer to the right arm retainer using the process described above.

A work platform or similar may be provided with one or more tool retainers 14 such that tools may be securely attached to the work platform when not being used. When the user requires a tool the tool holder 12 is transferred from the retainer on the work platform to a retainer secured to the user.

Whilst the drawings show the user's retainers mounted directly on wrist or waist belts, this is not essential. It is merely necessary that the retainer be secured to the user. As an example one or more retainers may be attached to a user or work platform by rope or cable or other tethers. However, using wrist and waist belts provides a relatively rigid mounting and aids in engaging a "free" retainer with the captive holder.

Figure 11:
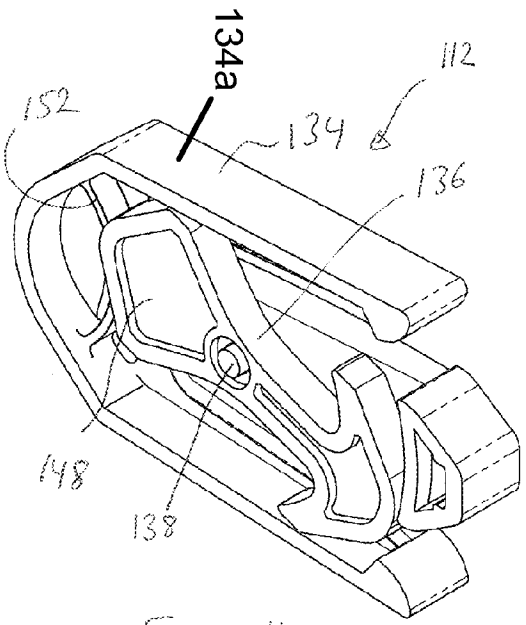
FIG. 11 is a sectioned perspective view of the tool mounting of FIG. 9.
Figure 9:
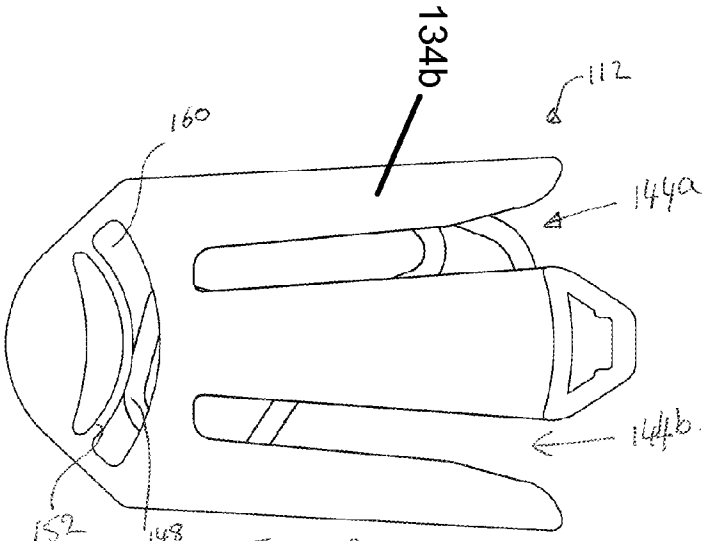
FIG. 9 is a side view of a tool mounting according to a second implementation of the invention.
Figure 10:
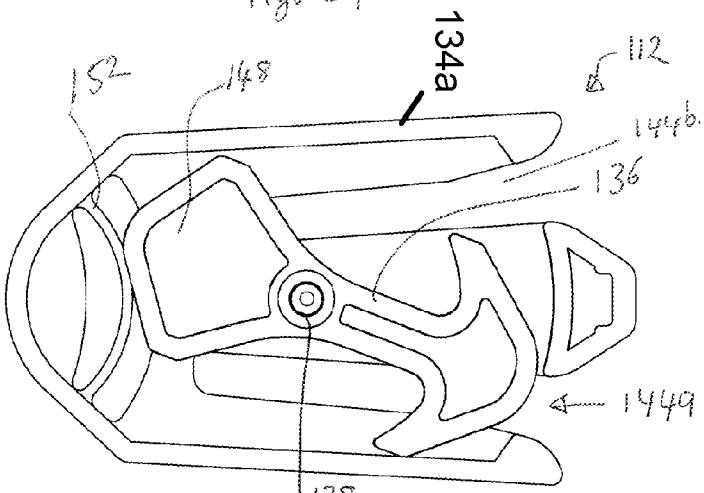
FIG. 10 is a sectioned side view of the tool mounting of FIG. 9.

FIGS. 9 to 11 show a tool mounting 112 similar to the tool mounting 12 of FIGS. 1 to 8. The tool mounting 112 operates substantially identically to tool mounting 12 and has latch 136 pivoting about axle 138 to alternatively cover the end of slots 144*a* and 144*b*. The axle 138 may be formed as part of one of the housing parts 134*a*, 134*b* and the latch 136 may be a press fit onto the axle. The latch 136 is biased to be over one of the slots 144*a* and 144*b* by spring member 152. The spring member 152 is preferably formed of a resilient plastics and integrally formed with housing part 134 but may be a separate component, whether metal, plastics or otherwise. One or both of the housing parts 134*a*, 134*b* are provided with a slot 160 that exposes part of the tail 148 of the latch 136. As best seen in FIG. 9, the slot extends either side of the tail. This slot provides the ability to manually release the mounting 112 from a retainer (not shown) held in one of the slots 144*a* and 144*b*. To do so the user may insert an implement, such as a screwdriver, into the slot 160 and engage the tail 148 to rotate the latch against the biasing force of spring so that the head moves from covering the end of one slot to covering the end of the other slot.

Figure 12:
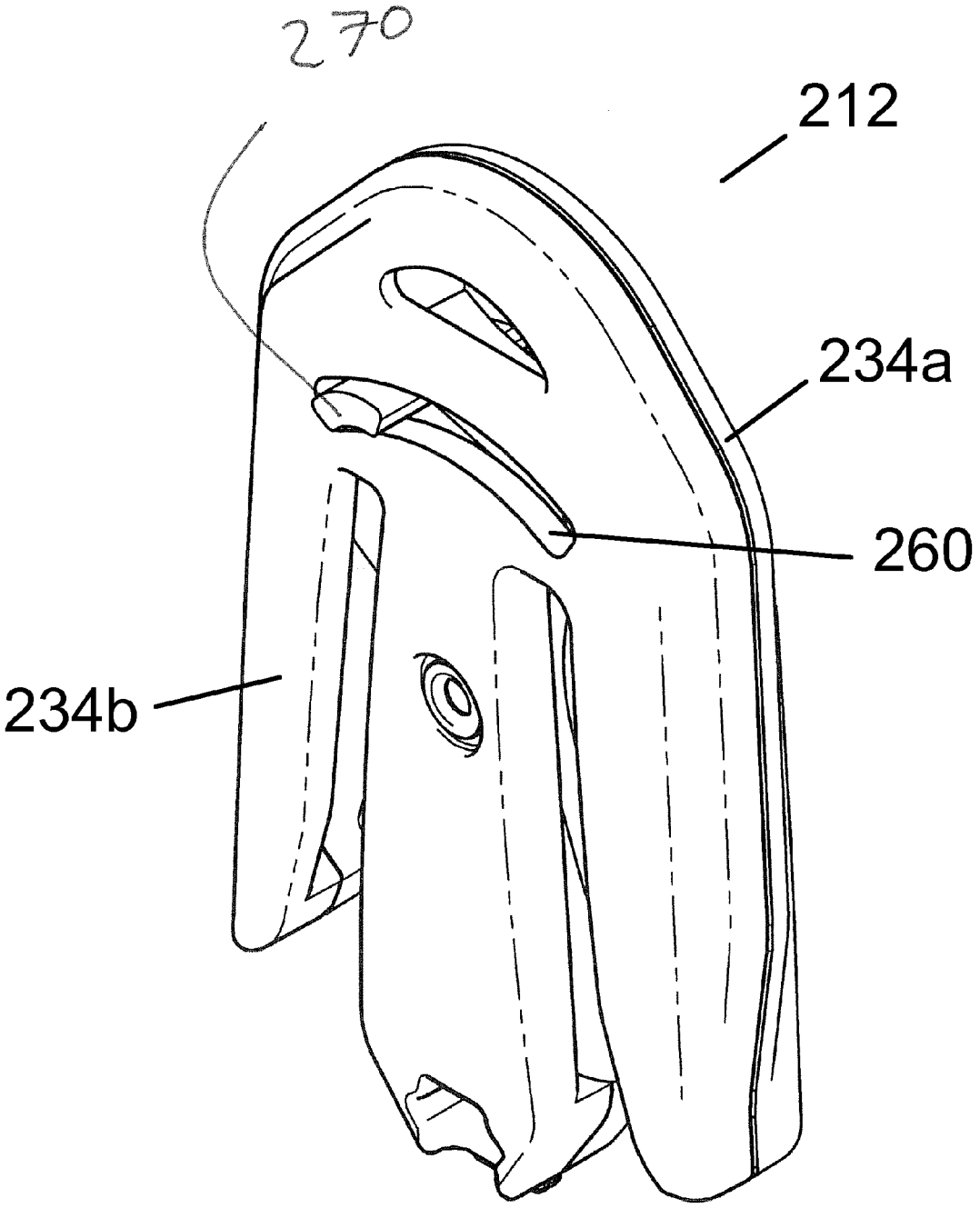
FIG. 12 is a perspective view of a tool mounting according to a third implementation of the invention.
Figure 14:
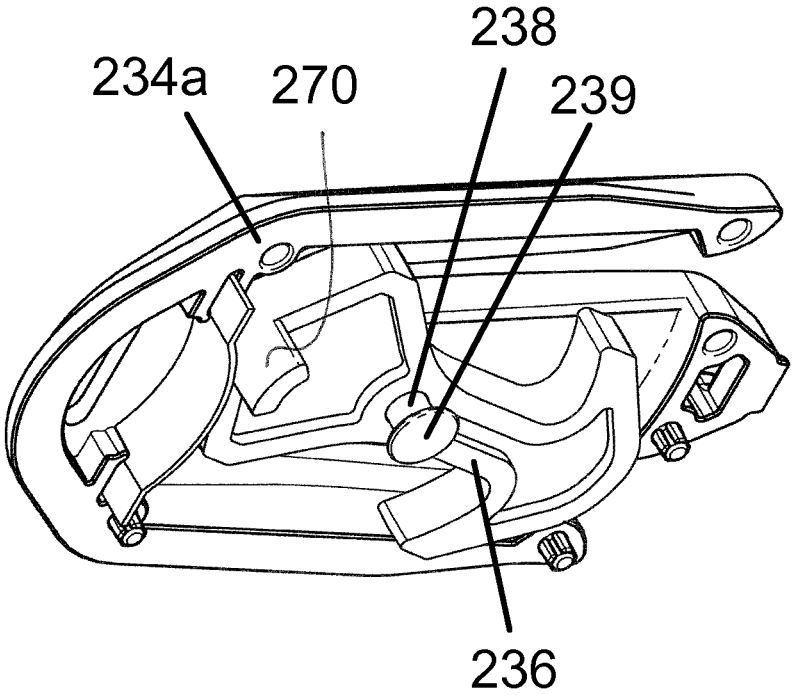
FIG. 14 is a sectioned perspective view of the tool mounting of FIG. 12.
Figure 13:
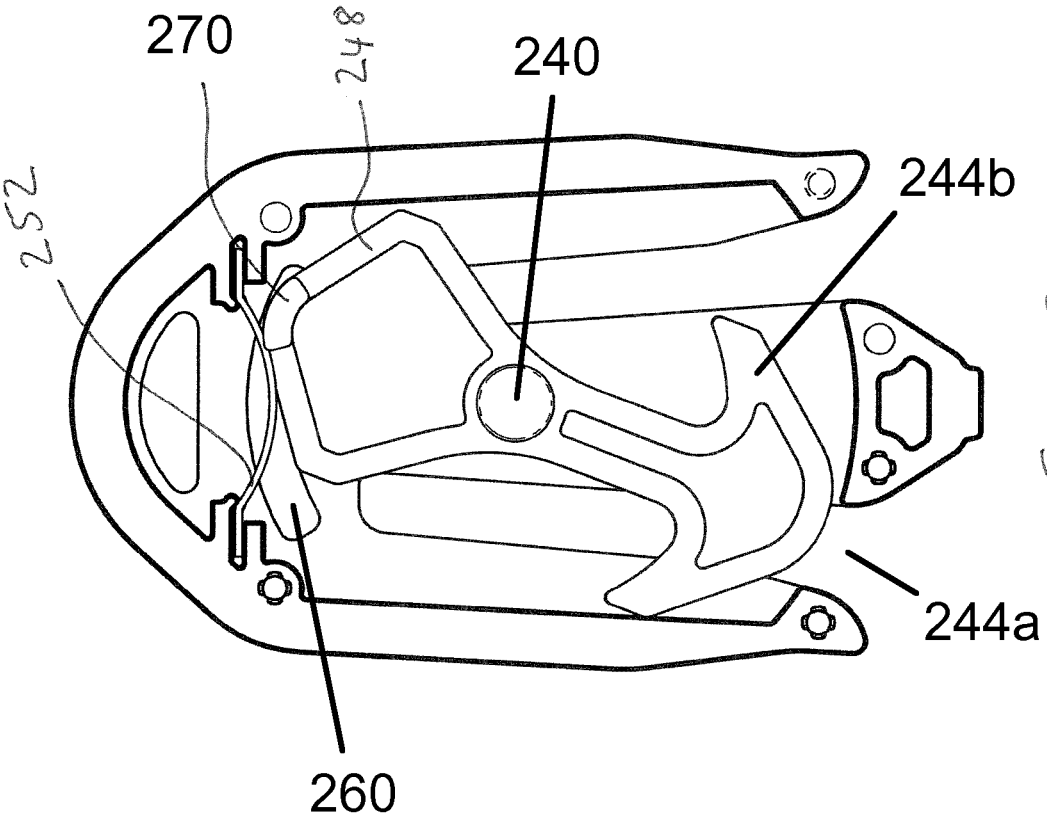
FIG. 13 is a sectioned side view of the tool mounting of FIG. 12.

FIGS. 12 to 14 show a tool mounting 212 similar to the tool mountings 12 and 112. The tool mounting 212 operates substantially identically to tool mountings 12 and 112 and has latch 236 pivoting about axle 238 to alternatively cover the end of slots 244*a* and 244*b*. The axle 238 may be formed as part of one of the housing parts 234*a* and 234*b* and the latch 236 may be a press fit onto the axle. Alternatively the axle may be a pin 239 that is heat staked or otherwise secured to one of the housing parts 234*a* and 234*b*. The pin 239 may have a head 240 to retain the latch 236 on the pin. The latch 236 is biased to be over one of the slots 244*a* and 244*b* by spring member 252. The spring member 252 is a separate component but may be formed integrally formed with housing part 234*a*.

The housing parts 234*a*, 234*b* are provided with an arc shaped slot 260 that exposes part of the tail 248 of the latch 236. The slot 260 is centred on the axle 238. The end of the tail 248 has manual release tabs 270 that extend into each slot 260. In either locked position the release tabs 270 are located toward an end of the slot 260. The housing need not have two slots 260 and may be made with only one slot 260.

The release tabs 270 extend out of the slots 260 and a user may engage one or both of the tabs 270 and rotate the latch against the biasing force of spring so that the head moves from covering the end of one slot to covering the end of the other slot. If desired the tabs may end flush with the housing parts 234*a* and 234*b*, so as to reduce the possibility of being caught on another object and accidentally releasing. If desired the tabs 270 may be recessed from the outer surface of the housing parts 234*a* and 234*b*. If desired, the slot may be sized so tabs 270 are not at the end of the slots when the latch is fully rotated. Thus a space may be provided between the end of the slot and the tab to aid engagement by a user's fingers.

Figure 15:
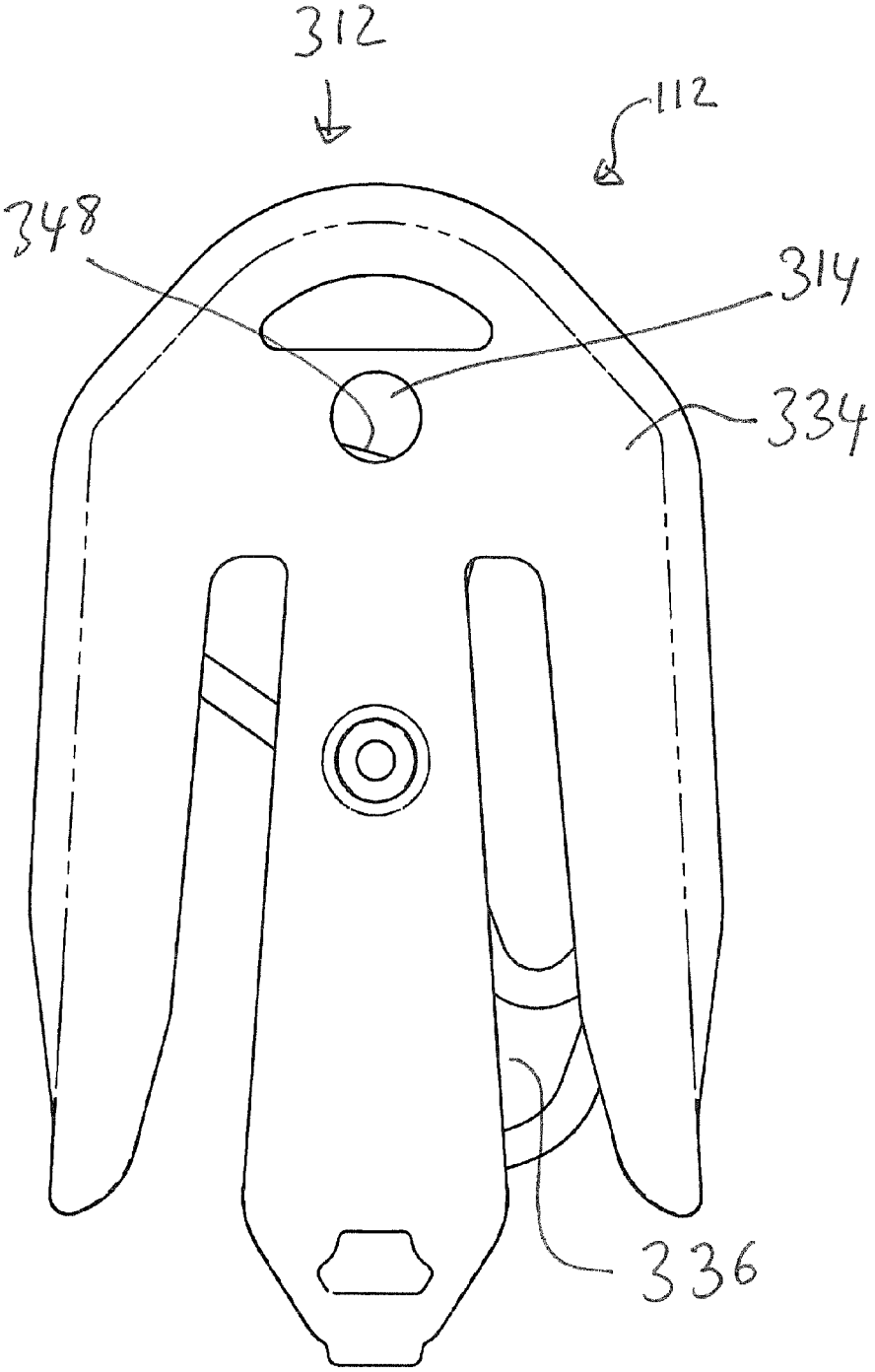
FIG. 15 is a side view of a tool mounting according to a fourth implementation of the invention.

FIG. 15 shows a mounting 312 that is substantially the same as mounting 12 but the housing 334 is provided with a centrally located locking aperture 314 adjacent tail 348 of latch 336. The locking aperture 314 is positioned so that as the latch 336 moves from one locking position to the other at least part of the tail passes "through" the locking aperture. Preferably the locking aperture is fully closed by the tail but partial closure can be sufficient. When the latch 336 is in either locking position the tail 348 lies to one side of central hole 314. The shackle of a padlock or similar may be passed through hole 314 to lock latch in one position.

FIGS. 16 to 19 show a tool attachment system 410 that is similar to that of system 10 and the operation of the system is substantially as previously described.

The main difference is that each of slots 444*a* and 444*b* in the housing 412 do not extend on both sides of latch member 436 but are only provided in one side of the housing 412. In the version shown the slots 444*a* and 444*b* are one either side of the housing and the housing is substantially symmetrical. However the slots 444*a* and 444*b* may be provided on the same side with the other side of the housing 412 a blank face.

Figures 16, 17, 18, 19:
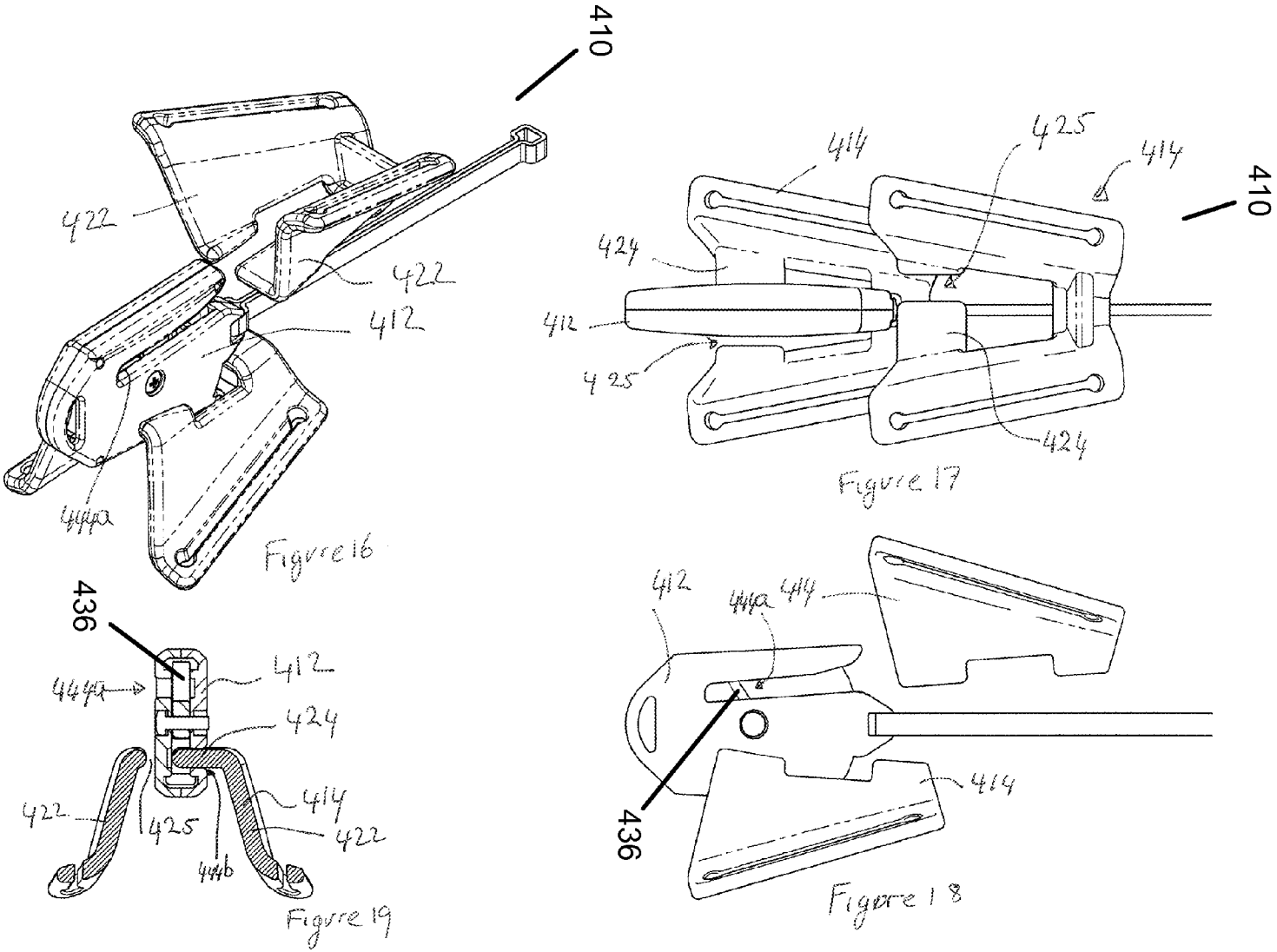
FIG. 16 is a perspective view of an attachment system according to a fifth implementation of the invention.
FIG. 17 is a plan view of the system of FIG. 16.
FIG. 18 is a side view of the system of FIG. 16.
FIG. 19 is a sectioned end view of the system of FIG. 16.

Since the slots 444*a* and 444*b* do not extend fully through the housing 412, the retainers 414 cannot have a rib that extends fully between side plates 422. Instead rib 424 extends from one side plate 422 part way toward the other, leaving a gap 425 that receives the housing 412, as best seen in FIG. 19. This provides the ability for the mounting 412 to only be picked up by a left or right sided retainers. This also has more security as the latch cannot be tripped by accidentally inserting a flat bar, rope or wire into the open slot to remove it the retainer must key into the slot. This version also provides for a user to manually release the retainer from the mounting by sliding the end of a rod or screwdriver along the open slot.

Figure 21:
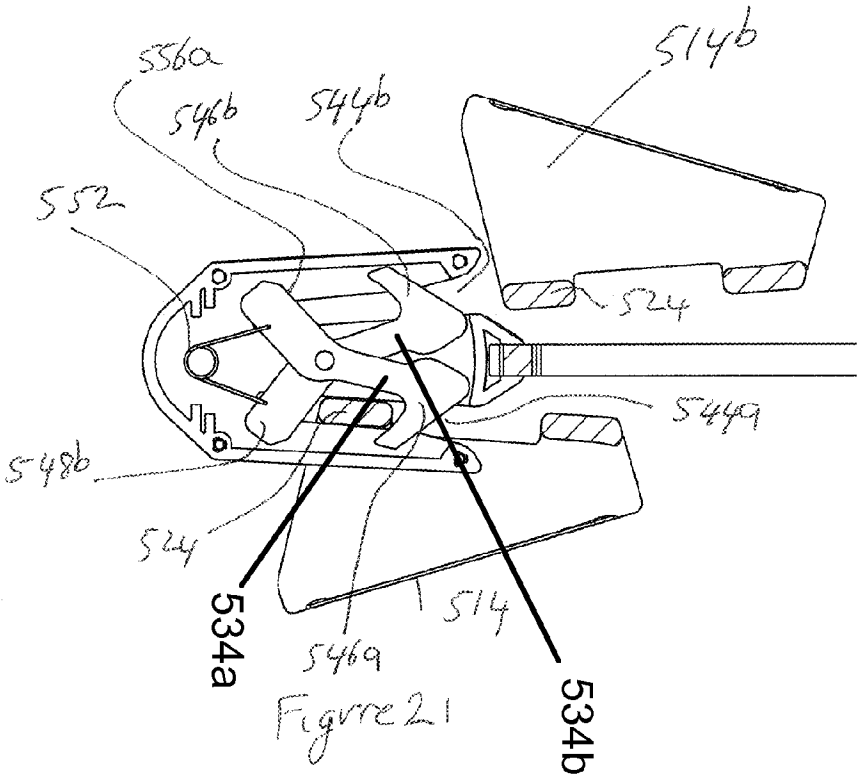
FIG. 21 is a sectioned side view of an attachment system according to a sixth implementation of the invention.
Figure 20:
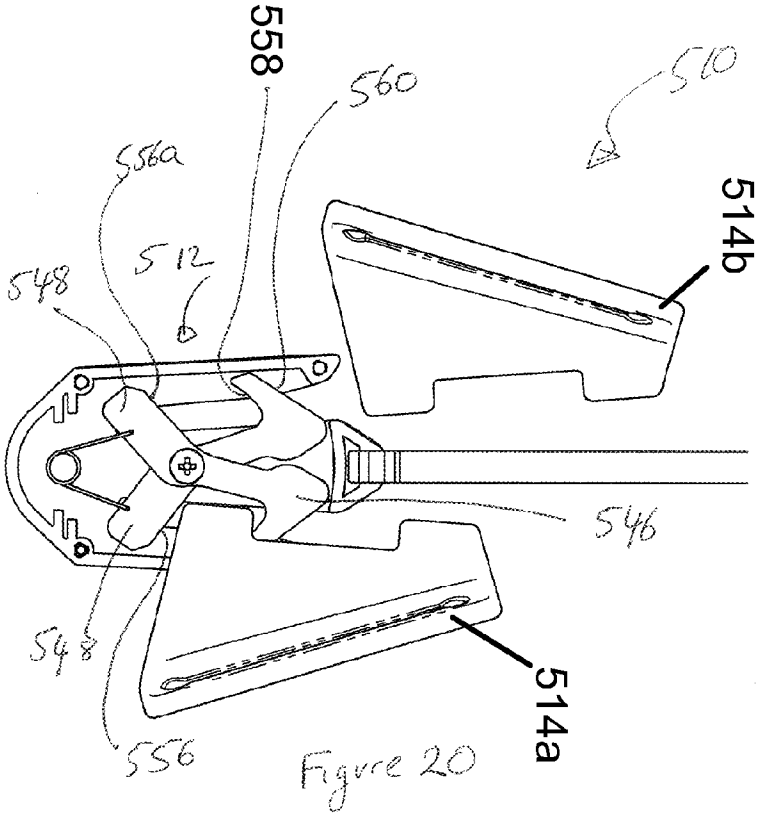
FIG. 20 is a side view of an attachment system according to a sixth implementation of the invention with a part of a housing not shown.

FIGS. 20 to 21 show a tool attachment system 510. The system utilises retainers 514 substantially the same as retainers 14 and a twin slot mounting 512 similar to the previously described mounting. However, the latch mechanism is not a single member but includes two latch members 534*a*, 534*b* mounted for rotation about common axle 538, one above the other. The two latch members 534*a*, 534*b* are substantially mirror images of each other and have heads 546 and tails 548. Each head has angled surfaces 558 and 560 whilst tail has angled surface 556. A rib 524 of a retainer 514 is trapped in slot 544*a* by the head 546*a* in a similar manner to the other embodiments.

A torsion spring 552 is connected to the two latch members 534 at their tails. The spring 552 is biased to separate the two tails and this causes the heads to the biased outwards.

In use, when a second retainer 514*b* is inserted into slot 544*b*, the rib 524*b* engages head 546*b* and urges it inwards toward the centreline of the device. This causes the tail to move inwards and, via spring 552, urge the head 564*a* of the other latch member outwards, maintaining the retaining function of that retaining member. Once the rib 524*b* has passed the head 564*b*, the head 564*b* springs outwards to prevent removal of the rib 542*b* from slot 546*b*. Continues motion causes the rib 524*b* to engage on surface 556*a* of latch member 534*a* and causes anticlockwise rotation, drawing head 546*a* inwards and clearing the opening of slot 544*a* and allowing retainer 514*a* to be removed from the mounting 512.

It will be appreciated that the features of the invention described or mentioned in this document in relation to one or more implementations may be combined in any combination of features of one or more other implementations where features are not mutually exclusive.

It will be apparent to those skilled in the art that many obvious modifications and variations may be made to the embodiments described herein without departing from the spirit or scope of the invention.

The claims defining the invention are as follows:

1. An attachment device adapted for use with at least two retainers, the device including:
- a first elongate slot having an open first end, the first slot adapted to receive a portion of a first retainer via the open first end;
- a second elongate slot having an open second end, the second slot adapted to receive a portion of a second retainer via the open second end;
- a first latch portion
- and a second latch portion;
- a first release portion having a first engagement surface, and
- a second release portion having a second engagement surface,
- wherein
- the first latch portion and the second release portion are connected together for rotation about a first axis;
- the second latch portion and the first release portion are connected together for rotation about a second axis;
- the first latch portion and second release portion are connected to the second latch portion and first release portion;
- the first latch portion is rotatable about the first axis between a first retaining position and a first open position and,
- in the first retaining position
  - the second engagement surface is located in the second slot at a second release position remote from the second end, and
  - at least part of the first latch portion extends into or across the first slot to substantially block the slot,
- and
- in the open position the first slot is not blocked by the first latch portion;
- the second latch portion is rotatable about the second axis between a second retaining position and a second open position, and in the second retaining position, the first engagement surface is located in the first slot at a first release position remote from the first end, and at least part of the second latch portion extends into or across the second slot to substantially block the slot, and in the open position the slot is not blocked by the second latch portion, and when in the first retaining position the first latch portion is located between the first end and the first release position, and when in the second retaining position the second latch portion is located between the second end and the second release position, and movement of the first release face away from the first release position and away from the first open end causes the second latch portion to move from the second retaining position toward the second open position and causes or urges movement of the first latch portion toward the first retaining position;

movement of the second release face and from the second release position and away from the second open end causes the first latch portion to move from the first retaining position toward the first open position and causes or urges movement of the second latch portion toward the second retaining position;

and when one of the first and second latch portions is between the respective open and retaining positions, the other of the first and second latch portions extends into the respective first or second slot.

2. The attachment device of claim 1 wherein the first and second slots are substantially linear, parallel and spaced apart and including a latch member, latch member including the first and second latch portions and the first and second release portions, the first and second axes being a single axis about which the latch member rotates, the single axis being located between the two slots and between the ends of the two slots.

3. The attachment device of claim 1 wherein when one of the first and second latch portions is at its respective retaining position the other of the first and second latch portions is at its respective open position.

4. The attachment device of claim 1 wherein movement of the first latch portion from the first retaining position to the first open position occurs with movement of the second latch portion from the second open position to the second retaining position.

5. The attachment device of claim 1 wherein the first and second latch portions are constrained to move as one.

6. The attachment device of claim 1 including at least one latch member.

7. The attachment device of claim 6 including a first latch member, wherein the first latch member includes the first latch portion.

8. The attachment device of claim 7 wherein the first latch member includes the first and second latch portions and the first and second release portions.

9. The attachment device of claim 7 wherein the first latch member includes the second release portion.

10. The attachment device of claim 7 wherein the first latch member includes the second latch portion.

11. The attachment device of claim 7 wherein the first latch member includes the second release portion.

12. The attachment device of claim 7 including a second latch member, the second latch member including the second latch portion.

13. The attachment device of claim 12 wherein the second latch member includes the first release portion.

14. The attachment device of claim 13 including at least one bias member engaging the first and second latch members to bias the first and second latch portions to a respective first and second retaining positions.

15. The attachment device of claim 6 wherein the or each at least one latch member is mounted for rotation about a respective axis of rotation.

16. The attachment device of claim 6 including two latch members, each latch member having at least one of the first and second latch portions and at least one of the first and second release portions.

17. The attachment device of claim 16 wherein the two latch members are mounted for rotation about a common axis.

18. The attachment device of claim 6 wherein when the first latch portion is in the retaining position the second latch portion is located outside of the second slot.

19. The attachment device of claim 1 wherein the device includes at least one bias member to bias at least one of the first and second latch portions to a respective retaining position.

20. The attachment device of claim 19 wherein at least one bias member is less biased when one of the first and second latch portions is at least one of the respective retaining or open positions than when the latch portion is intermediate the respective retaining or open positions.

21. The attachment device of claim 1 wherein movement of the first engagement surface away from the first open end moves the first latch portion further toward the first retaining position.

22. The attachment device of claim 21 wherein the first engagement surface and the first latch portion are locatable simultaneously within the first slot.

23. The attachment device of claim 2 wherein at least one of the first and second latch portions presents a face angled to the respective slot.

24. The attachment device of claim 2 wherein at least one of the first and second engagement surfaces is angled to the respective slot.

25. The attachment device of claim 1 wherein the first and second slots are closed or substantially closed at their other end.

26. The attachment device of claim 1 wherein at least the first slot is open at both ends and wherein the first retaining portion and the first release portion are configured to allow entry and exit from either end of the first slot.

27. The attachment device of claim 1 wherein the device has:

at least one latch with at least one head and at least one tail, the at least one latch mounted for rotation about a respective axis intermediate the head and tail;

the at least one head comprising at least one of the first and second latch portions;

the at least one tail comprising at least one of the first and second release portions;

the first and second slots extending either side of the axis and being closed at their other ends;

the at least one latch rotatable between first and second positions;

wherein, in either first or second position a head extends across one of the first and second slots between the open end and the respective closed end and the tail extends into the other of the first and second slots, and wherein rotation of the latch to the other of the first and second positions moves the head to extend into the other of the first and second slots.

28. An attachment system including an attachment device as claimed in claim 1 and at least one retainer.

29. An attachment system including an attachment device as claimed in claim 27 and at least one retainer.

* * * * *